US009687058B2

(12) United States Patent
Atkinson

(10) Patent No.: US 9,687,058 B2
(45) Date of Patent: Jun. 27, 2017

(54) HAND HELD APPLIANCE

(71) Applicant: Dyson Technology Limited, Wiltshire (GB)

(72) Inventor: Antoine Francois Atkinson, Swindon (GB)

(73) Assignee: DYSON TECHNOLOGY LIMITED, Malmesbury, Wiltshire (GB)

( * ) Notice: Subject to any disclaimer, the term of this patent is extended or adjusted under 35 U.S.C. 154(b) by 88 days.

(21) Appl. No.: 14/495,429

(22) Filed: Sep. 24, 2014

(65) Prior Publication Data

US 2015/0082652 A1 Mar. 26, 2015

(30) Foreign Application Priority Data

Sep. 26, 2013 (GB) ..... 1317099.8

(51) Int. Cl.
*A45D 20/12* (2006.01)

(52) U.S. Cl.
CPC ..... *A45D 20/122* (2013.01); *A45D 20/12* (2013.01)

(58) Field of Classification Search
CPC ..... A45D 20/12; A45D 20/04; A45D 20/122; F26B 21/00
USPC ..... 34/97, 98, 99, 100; 132/200, 212; 138/37
See application file for complete search history.

(56) References Cited

U.S. PATENT DOCUMENTS 1,931,339 A * 10/1933 Zingone ..... A45D 20/44 126/110 R
2,073,401 A * 3/1937 Crowley ..... A45D 20/22 248/408
3,224,454 A * 12/1965 Quinio ..... A45D 1/04 132/118
3,265,075 A * 8/1966 Edman ..... A45D 20/52 132/227

(Continued)

FOREIGN PATENT DOCUMENTS

CH 588 835 6/1977
CN 200973446 11/2007

(Continued)

OTHER PUBLICATIONS

International Search Report and Written Opinion mailed Dec. 18, 2014, directed to International Application No. PCT/GB2014/052850; 12 pages.

(Continued)

*Primary Examiner* — Stephen M Gravini
(74) *Attorney, Agent, or Firm* — Morrison & Foerster LLP

(57) ABSTRACT

Disclosed is a hand held appliance comprising a handle having an inner wall and an outer wall extending along and around the inner wall wherein the inner wall comprises a plurality of perforations extending at least partially along the inner wall. Perforations of the outer wall are spaced from the perforations of the inner wall. The inner wall and/or outer wall may comprise a plurality of perforations extending at least partially around the inner wall. The outer wall may comprise a plurality of perforations extending at least partially along the outer wall. The handle may comprise a first end and a second end. The inner wall may have a first end and a second end and the inner wall may extend from the (Continued)

first end of the handle towards the second end of the handle. Also disclosed is a hairdryer.

28 Claims, 10 Drawing Sheets

(56) References Cited

U.S. PATENT DOCUMENTS

| | | | | |
|---|---|---|---|---|
| 3,491,774 | A * | 1/1970 | Carbone | A45D 20/50 132/272 |
| 4,350,872 | A | 9/1982 | Meywald et al. | |
| 4,596,921 | A | 6/1986 | Hersh et al. | |
| 4,767,914 | A | 8/1988 | Glucksman | |
| 5,133,043 | A | 7/1992 | Baugh | |
| D350,413 | S | 9/1994 | Feil | |
| D352,365 | S | 11/1994 | Hansen et al. | |
| 5,365,037 | A * | 11/1994 | Chan | A45D 4/10 132/227 |
| 5,378,882 | A | 1/1995 | Gong et al. | |
| 5,546,674 | A | 8/1996 | Lange et al. | |
| 5,572,800 | A | 11/1996 | West | |
| 5,598,640 | A | 2/1997 | Schepisi | |
| 5,642,570 | A * | 7/1997 | Lee | A45D 19/16 34/98 |
| 5,649,370 | A * | 7/1997 | Russo | A45D 20/12 34/97 |
| 5,681,630 | A | 10/1997 | Smick et al. | |
| 5,810,911 | A | 9/1998 | Behrendt et al. | |
| 5,875,562 | A | 3/1999 | Fogarty | |
| 6,199,295 | B1 * | 3/2001 | Smal | A45D 20/122 34/98 |
| 6,203,349 | B1 | 3/2001 | Nakazawa | |
| 6,209,678 | B1 * | 4/2001 | Sterling | B25F 5/00 181/230 |
| 6,212,790 | B1 * | 4/2001 | Stetson | A45D 20/12 34/103 |
| 6,751,886 | B2 | 6/2004 | Chang et al. | |
| 6,889,445 | B1 | 5/2005 | Varona et al. | |
| 7,010,866 | B1 * | 3/2006 | Lin | A45D 20/30 34/96 |
| 7,065,899 | B2 * | 6/2006 | Lin | F24H 3/0488 34/97 |
| D550,813 | S | 9/2007 | Lammel et al. | |
| D646,354 | S | 10/2011 | Gessi | |
| 8,132,571 | B1 | 3/2012 | Jackson | |
| 8,146,264 | B1 | 4/2012 | Stefano et al. | |
| 8,256,132 | B2 * | 9/2012 | Gaillard | A45D 20/12 132/221 |
| 8,407,913 | B2 * | 4/2013 | Langley | A45D 19/16 132/271 |
| D696,386 | S | 12/2013 | Schoenherr et al. | |
| D702,322 | S | 4/2014 | Sieger | |
| 8,782,920 | B2 * | 7/2014 | Marthinsen | A45D 20/12 132/211 |
| 9,144,286 | B2 * | 9/2015 | Courtney | A45D 20/00 |
| 9,173,468 | B2 * | 11/2015 | Moloney | A45D 20/10 |
| 9,282,799 | B2 * | 3/2016 | Courtney | A45D 20/12 |
| 9,282,800 | B2 * | 3/2016 | Courtney | A45D 20/04 |
| 2004/0001707 | A1 | 1/2004 | Ryu et al. | |
| 2004/0020070 | A1 | 2/2004 | Ito | |
| 2004/0078992 | A1 | 4/2004 | Fujiwara | |
| 2004/0163274 | A1 | 8/2004 | Andrew et al. | |
| 2004/0172847 | A1 | 9/2004 | Saida et al. | |
| 2005/0123286 | A1 | 6/2005 | Lok | |
| 2005/0204577 | A1 | 9/2005 | Santhouse | |
| 2005/0229422 | A1 | 10/2005 | Mattinger et al. | |
| 2006/0070255 | A1 * | 4/2006 | Kokuo | A45D 20/06 34/96 |
| 2006/0075654 | A1 | 4/2006 | Lin | |
| 2006/0112586 | A1 | 6/2006 | Kim | |
| 2007/0294909 | A1 | 12/2007 | Abdi et al. | |
| 2009/0188126 | A1 | 7/2009 | Gaillard et al. | |
| 2010/0064542 | A1 | 3/2010 | Mulvaney et al. | |
| 2010/0065545 | A1 | 3/2010 | Chung et al. | |
| 2010/0071223 | A1 | 3/2010 | Ha | |
| 2011/0079239 | A1 | 4/2011 | Hall | |
| 2011/0177711 | A1 | 7/2011 | Park | |
| 2011/0203128 | A1 | 8/2011 | Rodrigues | |
| 2013/0111777 | A1 | 5/2013 | Jeong | |
| 2013/0160233 | A1 * | 6/2013 | Peace | A47L 9/1625 15/353 |
| 2013/0263464 | A1 | 10/2013 | Yoe | |
| 2013/0269200 | A1 | 10/2013 | Moloney et al. | |
| 2013/0269201 | A1 | 10/2013 | Courtney et al. | |
| 2013/0276320 | A1 | 10/2013 | Courtney et al. | |
| 2013/0276321 | A1 | 10/2013 | Courtney et al. | |
| 2013/0283630 | A1 | 10/2013 | Courtney et al. | |
| 2013/0283631 | A1 | 10/2013 | Moloney et al. | |
| 2014/0007448 | A1 | 1/2014 | Courtney et al. | |
| 2014/0007449 | A1 | 1/2014 | Courtney et al. | |
| 2014/0345156 | A1 | 11/2014 | Sayers et al. | |
| 2015/0082652 | A1 * | 3/2015 | Atkinson | A45D 20/12 34/97 |
| 2015/0265023 | A1 * | 9/2015 | Maclaine | A46B 9/023 132/212 |
| 2016/0235178 | A1 | 8/2016 | Atkinson et al. | |

FOREIGN PATENT DOCUMENTS

| | | |
|---|---|---|
| CN | 201011917 | 1/2008 |
| CN | 201328477 | 10/2009 |
| CN | 201341553 | 11/2009 |
| CN | 101292806 | 10/2010 |
| CN | 101953563 | 1/2011 |
| CN | 201774080 | 3/2011 |
| CN | 201948229 | 8/2011 |
| CN | 201968010 | 9/2011 |
| CN | 202035639 | 11/2011 |
| CN | 202146022 | 2/2012 |
| CN | 202436394 | 9/2012 |
| CN | 102726927 | 10/2012 |
| CN | 202456968 | 10/2012 |
| CN | 202536440 | 11/2012 |
| CN | 202653445 | 1/2013 |
| CN | 202774786 | 3/2013 |
| CN | 103082627 | 5/2013 |
| CN | 103082628 | 5/2013 |
| CN | 103156375 | 6/2013 |
| DE | 26 18 819 | 11/1977 |
| DE | 195 27 111 | 1/1997 |
| DE | 203 08 370 | 9/2003 |
| DE | 10 2009 049 838 | 4/2011 |
| EP | 0 105 810 | 4/1984 |
| EP | 0 300 281 | 1/1989 |
| EP | 0 306 765 | 3/1989 |
| EP | 0 970 633 | 1/2000 |
| EP | 1 433 401 | 8/2004 |
| EP | 1 616 500 | 1/2006 |
| EP | 1 661 481 | 5/2006 |
| EP | 2 000 042 | 12/2008 |
| EP | 2 002 752 | 12/2008 |
| EP | 2 086 367 | 8/2010 |
| EP | 2 255 692 | 12/2010 |
| EP | 2 392 223 | 12/2011 |
| EP | 2 401 939 | 1/2012 |
| EP | 2 497 385 | 9/2012 |
| EP | 2 642 884 | 8/2014 |
| FR | 1387334 | 1/1965 |
| FR | 1408096 | 8/1965 |
| FR | 2 907 642 | 5/2008 |
| GB | 647291 | 12/1950 |
| GB | 953057 | 3/1964 |
| GB | 1 446 385 | 8/1976 |
| GB | 1 456 000 | 11/1976 |
| GB | 1 489 723 | 10/1977 |
| GB | 1 539 485 | 1/1979 |
| GB | 2 295 056 | 5/1996 |
| GB | 2 316 868 | 3/1998 |
| GB | 2472240 | 2/2011 |
| GB | 2478927 | 9/2011 |
| GB | 2482547 | 2/2012 |
| GB | 2482548 | 2/2012 |
| GB | 2482549 | 2/2012 |

(56) References Cited

FOREIGN PATENT DOCUMENTS

| | | |
|---|---|---|
| GB | 2497192 | 6/2013 |
| GB | 2500798 | 10/2013 |
| GB | 2500800 | 10/2013 |
| GB | 2503684 | 1/2014 |
| GB | 2503685 | 1/2014 |
| GB | 2503686 | 1/2014 |
| JP | 55-113408 | 9/1980 |
| JP | 60-135700 | 7/1985 |
| JP | 60-249907 | 12/1985 |
| JP | 1-27506 | 1/1989 |
| JP | 1-29208 | 1/1989 |
| JP | 64-29208 | 1/1989 |
| JP | 64-72705 | 3/1989 |
| JP | 3-54166 | 5/1991 |
| JP | 4-221507 | 8/1992 |
| JP | 5-7507 | 1/1993 |
| JP | 5-130915 | 5/1993 |
| JP | 7-16113 | 1/1995 |
| JP | 7-155219 | 6/1995 |
| JP | 8-343 | 1/1996 |
| JP | 2000-201723 | 7/2000 |
| JP | 2001-37530 | 2/2001 |
| JP | 2002-238649 | 8/2002 |
| JP | 2003-153731 | 5/2003 |
| JP | 2004-312 | 1/2004 |
| JP | 2004-113402 | 4/2004 |
| JP | 2004-208935 | 7/2004 |
| JP | 2004-293389 | 10/2004 |
| JP | 2004-357763 | 12/2004 |
| JP | 2005-546 | 1/2005 |
| JP | 2006-51181 | 2/2006 |
| JP | 2006-130181 | 5/2006 |
| JP | 2006-181265 | 7/2006 |
| JP | 2006-181297 | 7/2006 |
| JP | 2006-204321 | 8/2006 |
| JP | 2006-288516 | 10/2006 |
| JP | 2007-136121 | 6/2007 |
| JP | 2009-28437 | 2/2009 |
| JP | 2009-268500 | 11/2009 |
| JP | 2010-274050 | 12/2010 |
| JP | 2012-20036 | 2/2012 |
| JP | 2012-45178 | 3/2012 |
| JP | 2013-252305 | 12/2013 |
| JP | 2013-255650 | 12/2013 |
| KR | 20-0400723 | 11/2005 |
| KR | 20-0423675 | 8/2006 |
| KR | 20-0461234 | 6/2012 |
| KR | 10-2012-0079871 | 7/2012 |
| KR | 10-1229109 | 2/2013 |
| TW | M421027 | 1/2012 |
| WO | WO-83/02753 | 8/1983 |
| WO | WO-94/23611 | 10/1994 |
| WO | WO-2004/006712 | 1/2004 |
| WO | WO-2005/120283 | 12/2005 |
| WO | WO-2007/043732 | 4/2007 |
| WO | WO-2008/053099 | 5/2008 |
| WO | WO-2012/059700 | 5/2012 |
| WO | WO-2012/069983 | 5/2012 |
| WO | WO-2012/076885 | 6/2012 |
| WO | WO-2013/018717 | 2/2013 |
| WO | WO-2014/034919 | 3/2014 |

OTHER PUBLICATIONS

Search Report dated Mar. 13, 2014, directed to GB Application No. 1317099.8; 1 page.

Reba, I. (1966). "Applications of the Coanda Effect," Scientific American 214:84-92.

* cited by examiner

HAND HELD APPLIANCE

REFERENCE TO RELATED APPLICATIONS

This application claims the priority of United Kingdom Application No. 1317099.8, filed Sep. 26, 2013, the entire contents of which are incorporated herein by reference.

FIELD OF THE INVENTION

This invention relates to a hand held appliance, in particular a hair care appliance such as a hairdryer or hot styling brush.

BACKGROUND OF THE INVENTION

Blowers and in particular hot air blowers are used for a variety of applications such as drying substances such as paint or hair and cleaning or stripping surface layers. In addition, hot air blowers such as hot styling brushes are used to style hair from a wet or dry condition.

Generally, a motor and fan are provided which draw fluid into a body; the fluid may be heated prior to exiting the body. The motor is susceptible to damage from foreign objects such as dirt or hair so conventionally a filter is provided at the fluid intake end of the blower. Conventionally such appliances are provided with a nozzle which can be attached and detached from the appliance and changes the shape and velocity of fluid flow that exits the appliance. Such nozzles can be used to focus the outflow of the appliance or to diffuse the outflow depending on the requirements of the user at that time.

SUMMARY OF THE INVENTION

According to a first aspect, the invention provides a hair care appliance comprising a handle having an inner wall and an outer wall extending along and around the inner wall wherein the inner wall comprises a plurality of perforations extending at least partially along the inner wall.

Preferably, the inner wall comprises a plurality of perforations extending at least partially around the inner wall.

In a preferred embodiment the outer wall comprises a plurality of perforations extending at least partially around the outer wall. Preferably, the outer wall comprises a plurality of perforations extending at least partially along the outer wall.

In a preferred embodiment perforations of the outer wall are spaced from the perforations of the inner wall. Thus there is no overlap between the perforations of the outer wall and the perforations of the inner wall.

Preferably, the handle comprises a first end and a second end.

In a preferred embodiment the inner wall has a first end and a second end and the inner wall extends from the first end of the handle towards the second end of the handle.

Preferably, the outer wall of the handle extends from the first end towards the second end of the handle. In a preferred embodiment the outer wall extends to the second end of the handle.

Preferably, perforations in the outer wall are adjacent the second end of the handle. In a preferred embodiment the perforations in the outer wall extend along the handle towards the first end.

Preferably, the perforations in the outer wall are longitudinally spaced from the perforations in the inner wall.

According to the invention there is provided a hair care appliance comprising a handle having an inner wall and an outer wall extending along and around the inner wall wherein the inner wall comprises a plurality of perforations extending at least partially along the inner wall wherein perforations of the outer wall are longitudinally spaced from the perforations of the inner wall.

In a preferred embodiment the appliance comprises a filter disposed within the outer wall extending across and around the perforations in the outer wall.

Preferably, the filter extends from the second end of the handle. Preferably, the filter extends from the second end towards the first end. In a preferred embodiment the filter extends from the second end of the handle to abut the second end of the inner wall.

The invention provides a hair care appliance comprising a handle having first end and a second end, an inner wall having a first end and a second end, the first end of the inner wall extending from the first end of the handle and an outer wall extending along and around the inner wall wherein the inner wall comprises a plurality of perforations extending at least partially along the inner wall comprising a filter disposed within the outer wall extending across and around the perforations in the outer wall wherein the filter extends from the second end of the handle to abut the second end.

Preferably, the second end of the inner wall is curved.

The invention provides a hair care appliance comprising a handle having first end and a second end, an inner wall having a first end and a second end, the first end of the inner wall extending from the first end of the handle and an outer wall extending along and around the inner wall wherein the inner wall comprises a plurality of perforations extending at least partially along the inner wall wherein the second end of the inner wall is curved.

In a preferred embodiment the inner wall comprises at least one supporting rib which projects between the inner wall and the outer wall. Preferably, the at least one supporting rib is curved around the inner wall. Alternatively or additionally, the at least one supporting rib extends longitudinally along the inner wall.

Preferably, a lining material is provided between the outer wall and inner wall of the handle.

In a preferred embodiment the perforations in the outer wall comprise a fluid inlet into the handle.

Preferably, the appliance comprises a fluid flow path extending along the handle from the fluid inlet, the fluid flow path being at least partially defined by the inner wall.

In a preferred embodiment the handle comprises a fan unit. Preferably, the inner wall comprises a housing for housing the fan unit in the handle. In a preferred embodiment the housing is between a first end of the handle and a second end of the handle.

Preferably, the first end of the handle is an upstream end of the handle. In a preferred embodiment the second end of the handle is a downstream end of the handle.

Preferably, the second end of the handle includes a fluid inlet.

In a preferred embodiment the inner wall includes a plurality of perforations between the second end and the housing for the fan unit.

Preferably, the inner wall is unperforated between the housing for the fan unit and the first end of the handle.

In a preferred embodiment the inner wall is formed from a first part and a second part.

Preferably, the first part and the second part join together to form a continuous inner wall.

In a preferred embodiment the first part extends from a first end of the inner wall to a second end of the inner wall.

Preferably, the second part extends from a first end of the inner wall to a second end of the inner wall.

In a preferred embodiment the first part and the second part of the inner wall are connected together via connecting struts. Preferably, the connecting struts are reinforcing ribs for the inner wall.

In a preferred embodiment the inner wall comprises a first portion adjacent the second end of the handle comprising a plurality of perforations, a second portion being unperforated and comprising the housing for the fan unit and a third portion extending from the second portion towards the first end of the inner wall which is unperforated.

Preferably, the appliance comprises a handle having an inner wall and an outer wall extending along and around the inner wall wherein the inner wall comprises a plurality of perforations extending at least partially along the inner wall.

Preferably, the hair care appliance is a hairdryer.

As the filter extends about each one of the plurality of apertures any fluid that flows through the plurality of apertures flows through the filter.

Preferably, the appliance comprises an outer wall wherein the inlet is in the outer wall. It is preferred that the apertures extend at least partially along the outer wall.

Preferably, the outer wall is tubular. It is preferred that the apertures extend at least partially around the outer wall.

Preferably, the filter is a foam block. It is preferred that the filter is cylindrical.

It is preferred that the inlet extends from the second end towards the first end.

Preferably, the filter extends further from the second end than the inlet.

In a preferred embodiment the appliance comprises an end wall extending across the outer wall at the second end. Preferably, the end wall comprises a plurality of apertures, preferably the plurality of apertures extend through the end wall. It is preferred that the apertures extending through the end wall form part of the fluid inlet into the appliance.

Preferably, the filter extends about the plurality of apertures through the end wall. It is preferred that the filter extends across the end wall.

Preferably, appliance includes a power cable and the power cable enters the appliance through the end wall. It is preferred that the filter includes an opening for accommodating the power cable. Preferably, the plurality of apertures in the end wall is spaced from the opening. It is preferred that the filter abuts the power cable.

Preferably, the appliance comprises an inlet, an outlet, a fluid flow path flowing from the inlet to the outlet and, a filter wherein the inlet comprises a plurality of apertures and the filter extends about each of the plurality of apertures.

Preferably the hair care appliance is a hairdryer.

Preferably, the plurality of apertures comprises a fluid inlet into the appliance.

In a preferred embodiment the end wall is flexible. Preferably, the end wall is made from a plastic material. It is preferred that the plastic material is one of polypropylene or acrylonitrile butadiene styrene (ABS).

Preferably, the end wall comprises a rim and a lip extending radially inwards of the rim. It is preferred that the lip is spaced from the rim by an extension from the rim. Preferably, a pair of lips is provided. It is preferred that the appliance comprises a recess for accommodating the lip(s). Preferably, the recess is formed in an inner surface of the handle. It is preferred that a pair of recesses is provided.

Preferably, the handle further comprises a removable filter. It is preferred that the removable filter is washable. Preferably, the filter is removable when the end wall is detached from the handle.

In a preferred embodiment the appliance comprises a filter scaffold which is retained with respect to the filter. Preferably, the filter scaffold extends beyond the filter providing access to pull to filter from the handle.

It is preferred that the handle has an outer wall having an outer surface which is externally accessible and an inner surface which defines an internal area of the handle. Preferably, the end wall extends radially across the outer wall. It is preferred that the end wall matches an outer diameter of the outer wall. Alternatively, the end wall has a larger diameter than the wall. It is preferred that the end wall includes an outer lip extending outwardly at least partially around an outer perimeter of the end wall.

Preferably, the end wall includes a further aperture defined by an inner rim of the end wall. It is preferred that the further aperture is disposed in the centre of the end wall.

In a preferred embodiment the appliance comprises a power cable for providing power from a power source to the appliance wherein the power cable extends through the further aperture. Preferably, the power cable is located within a housing which extends radially around the housing.

It is preferred that the housing comprises a recess extending radially around the housing. Preferably, the further aperture comprises a lip extending radially inwardly of the inner rim and the lip is adapted to cooperate with the recess.

It is preferred that when the end wall is detached from the handle, the end wall is retained on the power cable.

In a preferred embodiment the appliance comprises a fan unit for drawing fluid into the appliance. Preferably, the fan unit draws fluid through the end wall. It is preferred that the fan unit is in the handle.

Preferably, the second end of the handle comprises a plurality of apertures extending at least partially radially around the handle and along the handle from the second end.

Preferably, the appliance comprises a body, a handle having a first end connected to the body and a second end distal to the first end and an end wall extending across the handle at the second end of the handle wherein said end wall is detachable from the handle.

According to another aspect, the invention provides a hand held appliance comprising a handle having an inner wall and an outer wall extending along and around the inner wall wherein the inner wall comprises a plurality of perforations extending at least partially along the inner wall.

The invention provides a hand held appliance comprising a handle having an inner wall and an outer wall extending along and around the inner wall wherein the inner wall comprises a plurality of perforations extending at least partially along the inner wall wherein perforations of the outer wall are longitudinally spaced from the perforations of the inner wall.

The invention provides a hand held appliance comprising a handle having first end and a second end, an inner wall having a first end and a second end, the first end of the inner wall extending from the first end of the handle and an outer wall extending along and around the inner wall wherein the inner wall comprises a plurality of perforations extending at least partially along the inner wall comprising a filter disposed within the outer wall extending across and around the perforations in the outer wall wherein the filter extends from the second end of the handle to abut the second end.

The invention provides a hand held appliance comprising a handle having first end and a second end, an inner wall having a first end and a second end, the first end of the inner wall extending from the first end of the handle and an outer wall extending along and around the inner wall wherein the inner wall comprises a plurality of perforations extending at least partially along the inner wall wherein the second end of the inner wall is curved.

BRIEF DESCRIPTION OF THE DRAWINGS

The invention will now be described by way of example, with reference to the accompanying drawings, of which.

DETAILED DESCRIPTION OF THE INVENTION

Figure 2:
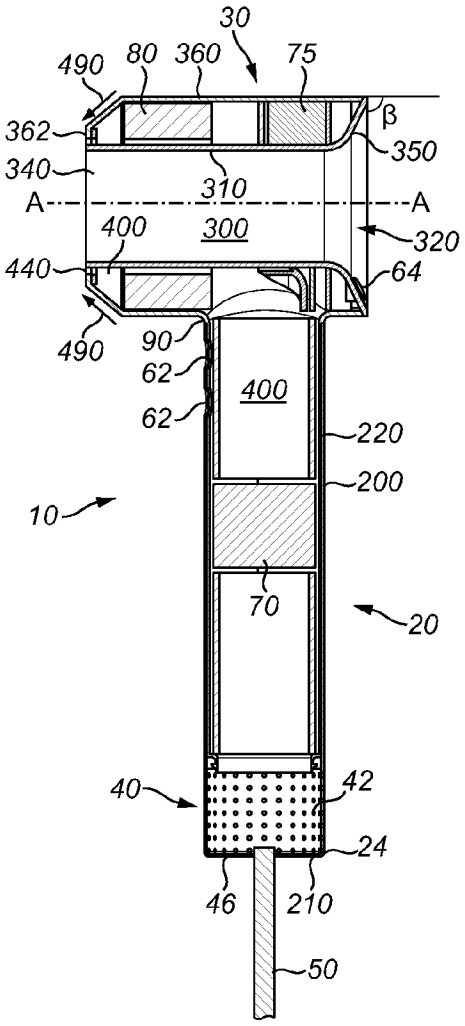
FIG. 2 shows a cross section through the appliance of FIG. 1.
Figure 1:
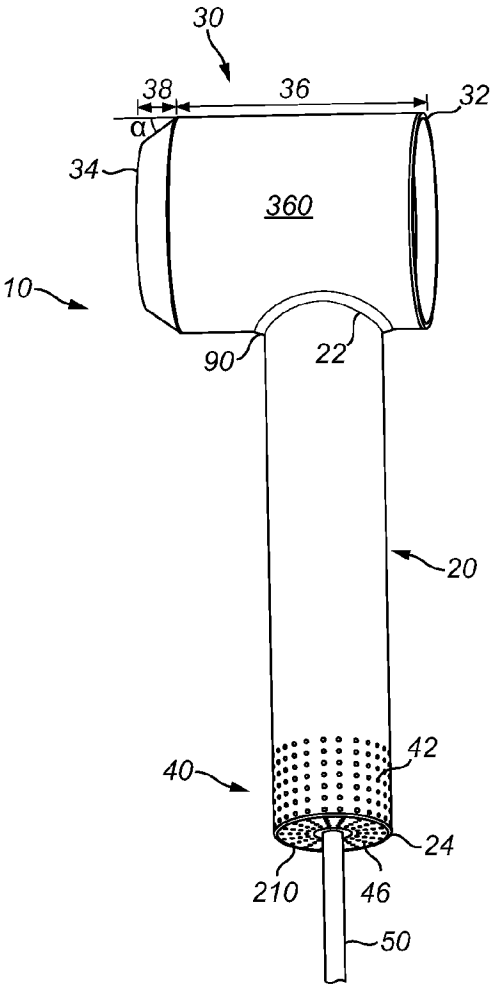
FIG. 1 shows a perspective view of an appliance according to the invention.

FIGS. 1 and 2 show a hairdryer 10 with a handle 20 and a body 30. The handle has a first end 22 which is connected to the body 30 and a second end 24 distal from the body 30 and which includes a primary fluid inlet 40. Power is supplied to the hairdryer 10 via a cable 50.

The body 30 has a first end 32 and a second end 34 and can be considered to have two parts. A first part 36 which extends from the first end 32 which is generally tubular and a second part 38 which extends from the second end 34 to join the first part 36. The second part 38 is cone shaped and varies in diameter along its length from the diameter of the first part 36 of the body 30 to a smaller diameter at the second end 34 of the body. In this example, the second part 38 has a constant gradient and the angle $\alpha$ subtended from the outer wall 360 of the first part 36 of the body 30 is around 40°.

The handle 20 has an outer wall 200 which extends from the body 30 to a distal end 24 of the handle. At the distal end 24 of the handle an end wall 210 extends across the outer wall 200. The cable 50 enters the hairdryer through this end wall 210. The primary fluid inlet 40 in the handle 20 includes first apertures that extend around and along 42 the outer wall 200 of the handle and second apertures that extend across 46 and through the end wall 210 of the handle 20. The cable 50 is located approximately in the middle of the end wall 210 so extends from the centre of the handle 20. The end wall 210 is orthogonal to the outer wall 200 and an inner wall 220 of the handle.

It is preferred that the cable 50 extends centrally from the handle 20 as this means the hairdryer is balanced regardless of the orientation of the handle 20 in a users' hand. Also, if the user moves the position of their hand on the handle 20 there will be no tugging from the cable 50 as it does not change position with respect to the hand when the hand is moved. If the cable were offset and nearer one side of the handle then the weight distribution of the hairdryer would change with orientation which is distracting for the user.

Upstream of the primary fluid inlet 40, a fan unit 70 is provided. The fan unit 70 includes a fan and a motor. The fan unit 70 draws fluid through the primary fluid inlet 40 towards the body 30 through a primary fluid flow path 400 that extends from the primary fluid inlet 40 and into the body 30 where the handle 20 and the body 30 are joined 90. The primary fluid flow path 400 continues through the body 30 towards the second end 34 of the body, around a heater 80 and to a primary fluid outlet 440 where fluid that is drawn in by the fan unit exits the primary fluid flow path 400. The primary fluid flow path 400 is non linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the duct 310 towards the primary fluid outlet 440 at the second end 34 of the body 30.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the duct 310 which is an inner wall of the body 30 and extends within and along the body. A fluid flow path 300 extends within the duct from the fluid inlet 320 to the fluid outlet 340. At the first end 32 of the body 30, a side wall 350 extends between the outer wall 360 and the duct 310. This side wall 350 at least partially defines the fluid inlet 320. At the second end 34 of the body a gap is provided between the outer wall 360 and the duct, this gap defines the primary fluid outlet 440. The primary fluid outlet 440 is annular and surrounds the fluid flow path. The primary fluid outlet 440 may be internal so the primary fluid flow path 400 merges with the fluid flow path 300 within the body 30. Alternatively, the primary fluid outlet 440 is external and exits from the body 30 separately to the fluid from the fluid flow path 300 at the fluid outlet 340.

The outer wall 360 of the body converges towards the duct 310 and a centre line A-A of the body 30. Having an outer wall 360 that converges towards the duct 310 has the advantage that the primary flow exiting the primary fluid outlet 440 is directed towards the centre line A-A of the body 30. The fluid exiting the primary fluid outlet 440 will cause some external entrainment of fluid 490 from outside the hairdryer due to the movement of the fluid from the primary outlet 440. This effect is increased by the outer wall 360 converging towards the duct 310. Partly this is because the primary flow is focused rather than divergent and partly this is because of the slope of the outer wall 360 of the body 30 towards the second end 34 of the hairdryer.

The duct 310 is an internal wall of the hairdryer that can be accessed from outside the hairdryer. Thus, the duct 310 is an external wall of the hairdryer. The duct 310 is recessed within the body 30 so the side wall 350 that connects between the outer wall 360 and the duct 310 is angled with respect to the outer wall 360.

A PCB 75 including the control electronics for the hairdryer is located in the body 30 near the side wall 350 and fluid inlet 320. The PCB 75 is ring shaped and extends round the duct 310 between the duct 310 and the outer wall 360. The PCB 75 is in fluid communication with the primary fluid flow path 400. The PCB 75 extends about the fluid flow path 300 and is isolated from the fluid flow path 300 by the duct 310.

The PCB 75 controls such parameters as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 2, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Figure 3C:
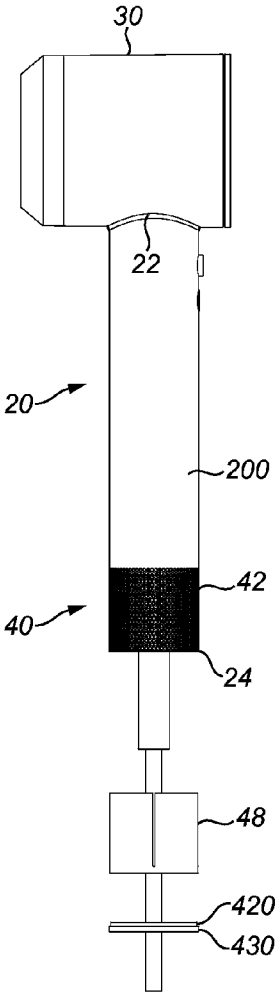
FIGS. 3*a*, 3*b* and 3*c* show different views of an appliance with an exploded inlet.
Figure 3B:
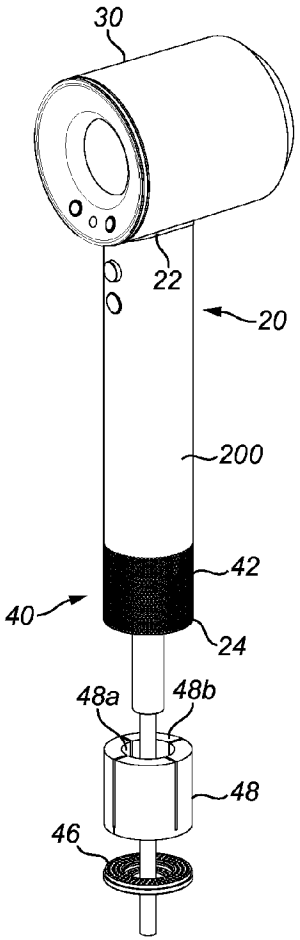
Figure 3A:
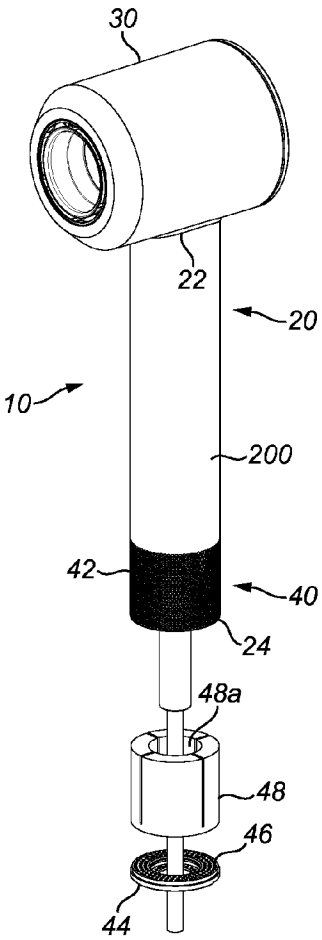

FIGS. 3*a*, 3*b* and 3*c* show perspective exploded views of the primary fluid inlet 40 of the hairdryer 10 in more detail. The appliance 10 includes a body 30 and a handle 20. The handle 20 is tubular and the outer wall 200 of the handle 20 is a cylindrical sleeve made from a rolled sheet of metal such as aluminium, an aluminium alloy or a steel. The handle connects to the body 30 at a first end 22 and at the distal, second end 24 a primary fluid inlet 40 is provided. The primary fluid inlet 40 is a first means of filtering fluid that enters the primary fluid flow path 400.

A foam block 48 is provided which in use is inserted into the second end 24 of the handle 20. The foam block 48 is a second means of filtering the fluid that passes through the primary fluid inlet 40 into the primary fluid flow path 400. It is advantageous that the foam block 48 extends beyond of further towards the first end 22 of the handle than the primary fluid inlet 40 as this ensures that fluid that has entered the primary fluid inlet 40 has passed through the foam block 48 so has had two stages of filtration.

The foam block 48 shown is cylindrical and substantially fills the area within the handle 20 at the primary fluid inlet 40. This is to ensure that all fluid that enters the primary fluid inlet through first apertures 42 that extend around and along the handle and fluid that enters through second apertures 46 that extend across and through the end wall 210 of the handle 20 passes through this second stage of filtration. The foam block 48 extends longitudinally from the second end 24 of the handle 20 further than the first apertures 42 of the primary fluid inlet 40.

If the primary fluid inlet 40 extended solely around and along 42 the outer wall of the handle 20, the foam block 48 could comprise a rectangular block formed into a ring and positioned against the inner surface of the outer wall 200 of the handle 20. There would be no need to cover the end wall 210 of the handle 200 as no fluid would enter the handle 20 through the end wall 210.

Figure 4:
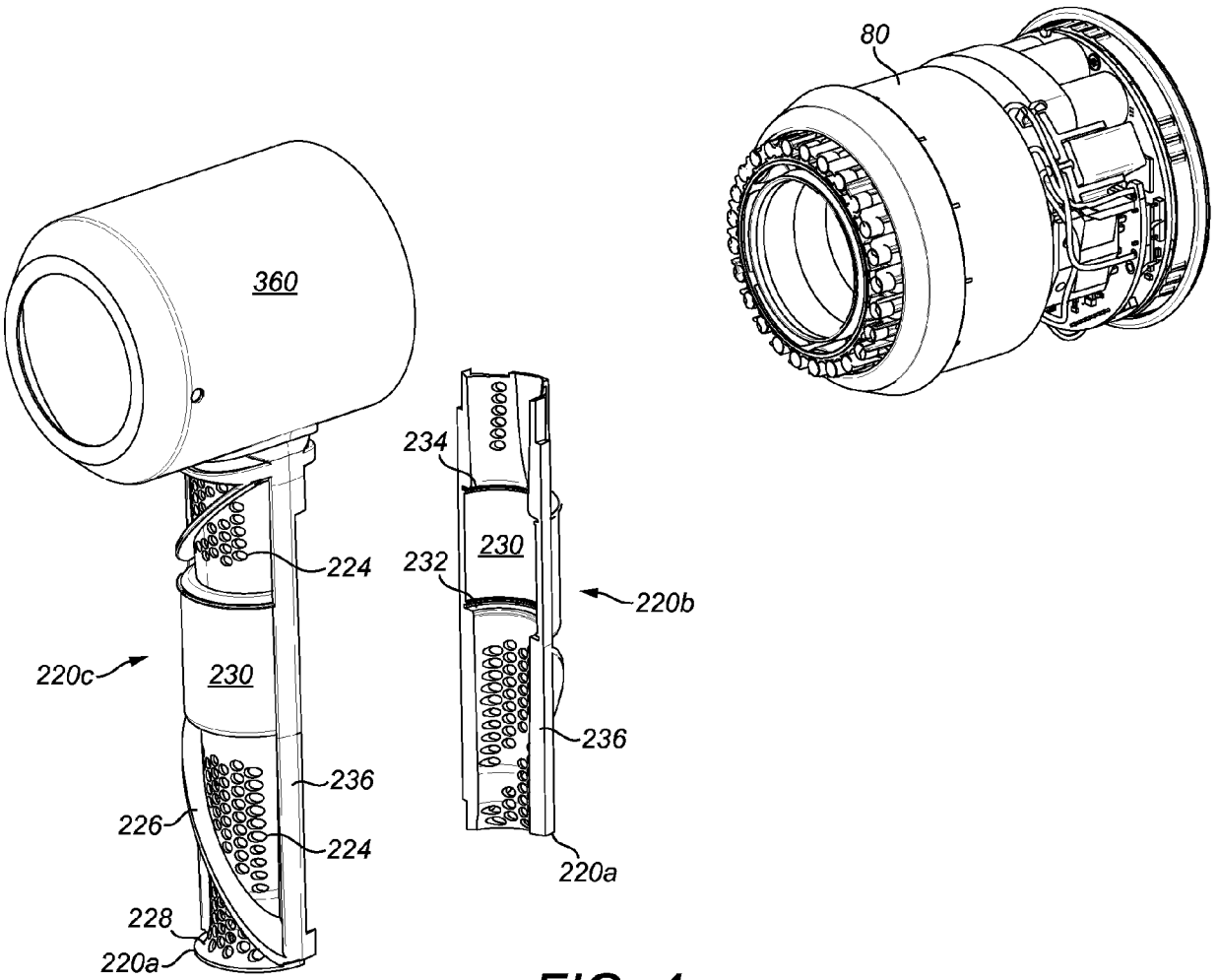
FIG. 4 shows an exploded perspective view of an appliance according to the invention.
Figure 5:
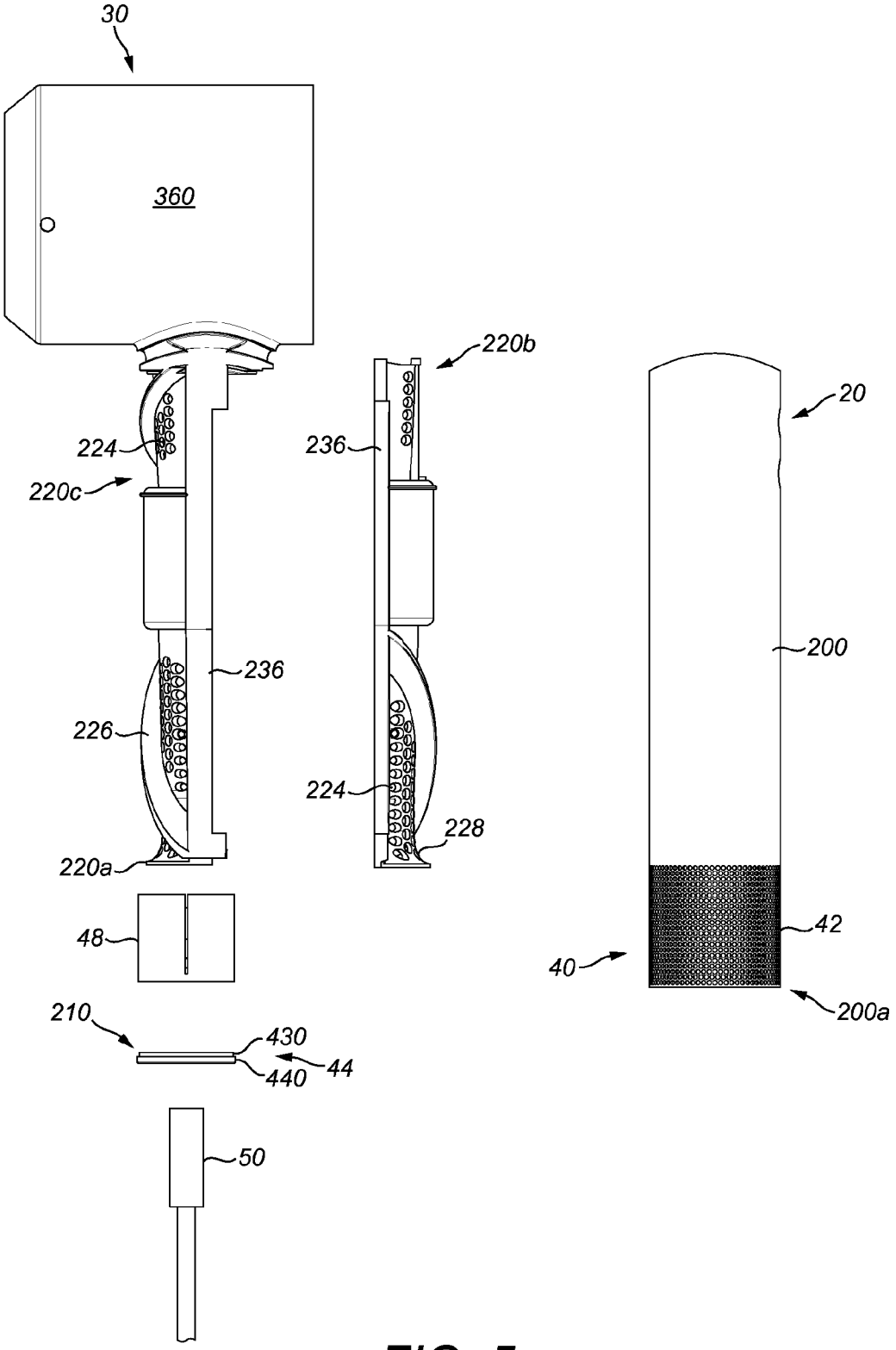
FIG. 5 shows an exploded side view of the different handle parts.
Figure 7:
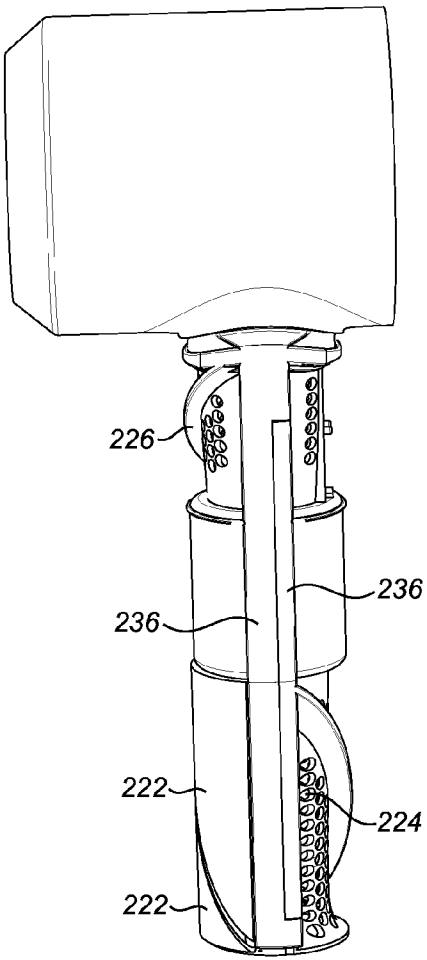
FIG. 7 an assembled inner handle.
Figure 6:
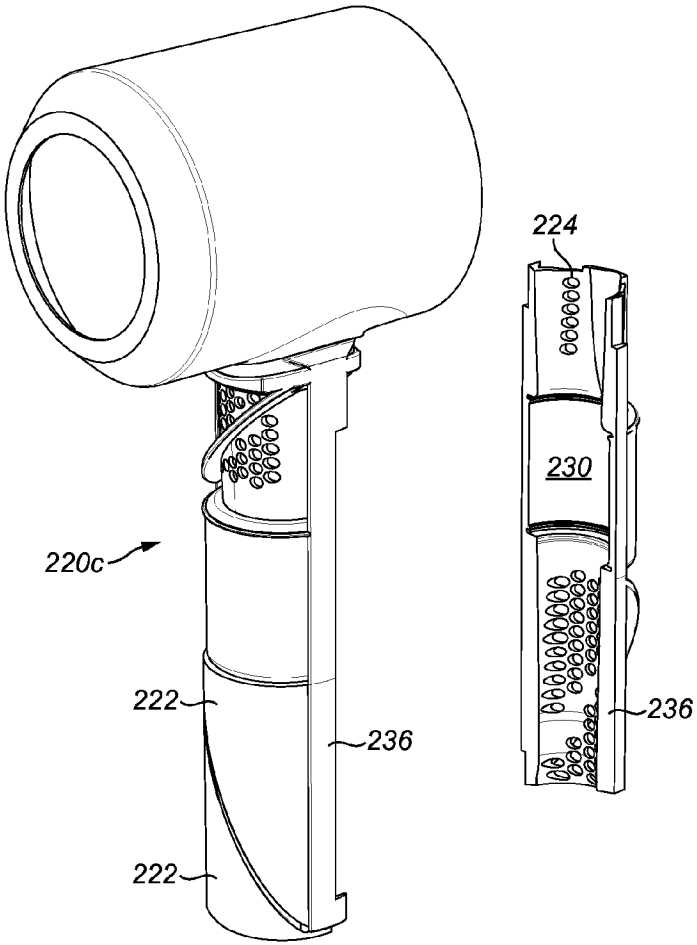
FIG. 6 a perspective view of the inner handle.

FIG. 4 shows an exploded perspective view of an appliance according to the invention; FIG. 5 shows an exploded side view of the different handle parts; FIG. 6 a perspective view of the inner handle; and FIG. 7 an assembled inner handle.

The handle 20 has an outer wall 200 and an inner wall 220 which at least partially defines the primary fluid flow path 400 through the handle 20. The inner wall 220 extends from the body 30 to a downstream end 220*a* towards the second end 24 of the handle 20 but, the inner wall 220 does not extend as far as the first apertures 42 that form part of the primary fluid inlet 40. The inner wall 220 abuts the foam block 48 at the downstream end 220*a*. The inner wall 220 is spaced from the first apertures 42 of the primary fluid inlet 40.

The inner wall 220 is shaped to guide fluid flow around changes in cross-sectional area of the primary fluid flow path 400. For example at the downstream end 220*a* of the inner wall 220 the inner wall curves from the outer wall 200 radially inwards along the primary fluid flow path 400. This curved section 228 guides fluid that exits from the filter block 48 into the inner wall 220 which has a reduced diameter to that of the outer wall 200 to accommodate a lining material 222 that is positioned between the inner wall 220 and the outer wall 200. The lining material 222 is a foam or a felt which at least attenuates noise (has a silencing effect) produced when fluid is drawn into the handle 20 by the fan unit 70. For clarity, the lining material 222 has been shown around only a part of the inner wall 220. In reality, the lining material 22 would substantially fill each octant of the inner wall 220 defined by the reinforcing ribs 226. To enable contact between the lining material 222 and the fluid flowing in the primary fluid flow path 400 and thus attenuation of noise, the inner wall 220 is provided with perforations 224 that extend around and at least partially along the length of the inner wall 220. As the inner wall 220 does not extend over the first apertures 42 of the primary fluid inlet 40, the perforations 224 within the inner wall 220 are longitudinally spaced from the first apertures 42 of the primary fluid inlet 40.

The outer wall 360 of the body 30 and a first part 220*c* of the inner wall 220 of the handle 20 are moulded as a single piece. A second part 220*b* of the inner wall 220 forms together with the first part 220*c* a continuous inner wall 220 extending around the inside of the outer wall 200. The inner wall 220 extends from the body towards the primary fluid inlet 40 of the handle. In this example, the inner wall 220 does not overlap with the primary fluid inlet 40 in the outer wall 200 of the handle 20. Between the end 220*a* of the inner wall 220 and the end wall 210 of the handle 200 is a foam block 48.

The first apertures 42 that extend along and around the outer wall 200 are machined, punched or laser cut from the sheet metal that the outer wall 200 is formed from. The outer wall 200 slides over the inner handle 220 to form the finished product.

Figure 10:
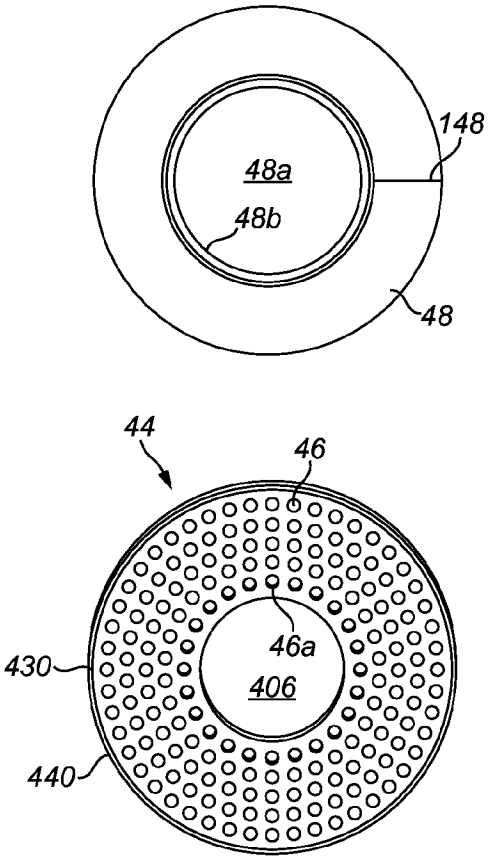
FIG. 10 shows a plan view of the filter block and detachable portion.
Figure 9:
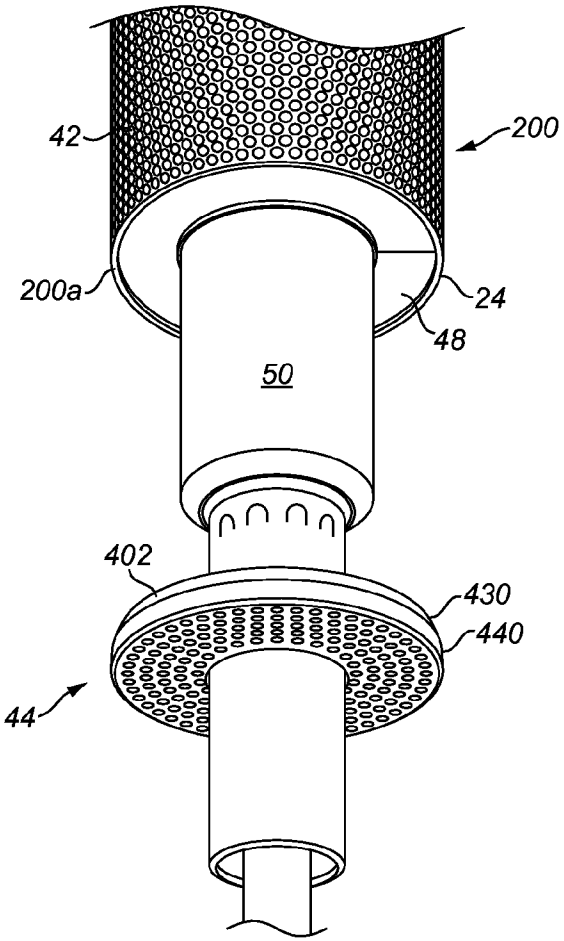
FIG. 9 shows the inlet of FIG. 8 with the detachable portion detached.
Figure 8:
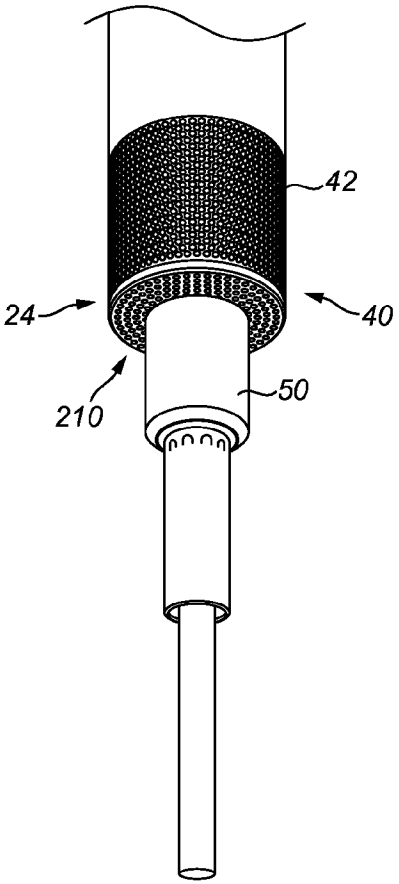
FIG. 8 shows an angled view of an inlet.

Referring to FIGS. 8, 9 and 10 in particular, the primary fluid inlet 40 is intended to prevent hair and non-fluid hair care products (mousses and waxes for example) from entering the primary fluid flow path 400. The external surface of the primary fluid inlet 40 can be wiped in order to remove hair, fibres and dust and unblock the apertures 42 of the primary fluid inlet 40. The foam block 48 is preferably a reticulated foam block and is intended to prevent hair ingress and airborne particles from entering the primary fluid flow path 400. As this foam block 48 is not eternally accessible for cleaning or replacement, the primary fluid inlet 40 has been provided with a detachable portion 44 which when removed enables a user to remove the foam block 48 from inside the outer handle 200 for cleaning or replacement.

The detachable portion 44 includes the end wall 210 of the handle 20 and has an external rim 430 which includes a lip 440 which extends over the end 200*a* of the outer wall 200 and across at least the radius of the outer wall 200 of the handle. The detachable portion 44 also includes the second apertures 46 that form part of the primary fluid inlet 40 into the handle 20.

In this example the lip 440 extends beyond the outer wall 200 of the handle 20 which enables a user to grip the end wall 44 at the lip 440 to peel it from the end 200*a* of the handle. The detachable portion 44 is made from a flexible material such as a plastic or rubber enabling it to be manipulated on and off the distal end 24 of the handle 20.

The detachable portion 44 also includes an inner portion 402 which when attached to the second end 24 of the handle extends inside the outer wall 200 this ensures a good seal is made between the two parts 42, 44 of the primary fluid inlet 40.

The detachable portion 44 includes a further aperture 406 through which a power cable 50 extends into the handle 20. The further aperture 406 is central to the detachable portion 44. The power cable 50 is fixed to the handle 20 so when the detachable portion 44 of the primary fluid inlet 40 is removed from the end 24 of the handle it remains on the power cable 50. This means that the detachable portion 44 cannot be accidentally misplaced when the foam block 48 is being removed for washing or replaced. To return the detachable portion 44 to the end 24 of the handle one simple pulls the detachable portion 44 along the power cable 50 and then pushes it onto the end 24 of the handle.

The foam block 48 is cylindrical with a central aperture 48*a* (FIG. 3 and FIG. 10) for accommodating the power cable 50. In order to remove the filter block 48 from the power cable 50, a slit 148 is provided through the thickness of the foam block 48. The foam block 48 is flexible enough to be pulled apart at the slit 148 enabling the foam block 48 to be removed from surrounding the power cable 50.

To ensure that all fluid that enters the primary fluid inlet 40 through the second apertures 46 formed in the detachable portion 44 is filtered by passing through the foam block 48, the second apertures 46 are spaced from the further aperture 406 provided in the detachable portion 44. The diameter of the central aperture 48*a* of the foam block 48 is smaller than the diameter of the further aperture 406 of the detachable portion 44 plus two times the distance between the innermost row 46*a* of the second apertures 46 and the further aperture 406 of the detachable portion 44. This ensures an overlap of the foam block 48 with all of the second apertures 46.

As the detachable portion 44 is flexible, it seals around the outer edge of the power cable 50 preventing fluid from entering the fluid flow path without passing through the primary fluid inlet 40.

Referring to FIGS. 4 to 7 in particular, the inner wall 220 has a number of different functions. One function is to delimit lining material 222 which is disposed within the handle 20. The inner wall 220 pushes and squashes the lining material 222 against the outer wall 200 ensuring that the primary fluid flow path 400 is not restricted by the lining material 222. For reasons of clarity, the lining material 222 has only been shown along and around a portion of the inner wall 220 but in practice the lining material 222 is substantially continuous between the outer wall 200 and inner wall 220 of the handle 200. The lining material 222 is a foam or a felt and provides an acoustic barrier and thermal barrier for the handle 20.

Another function of the inner wall 220 is to provide a housing 230 in which a fan unit 70 is disposed. The housing 230 is cylindrical and has an inwardly protruding ledge 232,234 disposed one at each end of the housing 230 which maintain the position of the fan unit 70 within the handle 20. The fan unit 70 draws fluid into the primary fluid inlet 40 and along the primary fluid flow path 400 to the body 30. This process produces noise and vibrations which are in part attenuated by the lining material but are also attenuated by the shape of the inner wall 220 and perforations 224 provided along and around the inner wall 220.

The inner wall 220 is provided with reinforcing ribs 226 which spiral around the outer diameter of the inner wall 220. The reinforcing ribs 226 provide a structural support for the handle 20 in the event that the hairdryer 10 is dropped or knocked. In this embodiment, the lining material 222 is cut into pieces which fit between the reinforcing ribs 226 however, the lining material could be provided as a continuous piece. There are advantages and disadvantages to both options from the point of assembly, attenuation of noise and vibrations and effectiveness of the reinforcing ribs 226.

Further longitudinal reinforcing ribs are provided in the form of connecting struts 236. The connecting struts extend longitudinally along the cooperating edges of the first part 220*c* and second parts 220*b* of the inner wall 220. The connecting struts have two functions, one is to reinforce the inner wall 220 and the other is to provide a positive connection between the first part 220*c* and the second part 220*b* of the inner wall.

The use of reinforcing ribs means that the inner wall 220 can be made thinner for the same strength of handle which reduces the weight of the product. The perforations 224 also reduce the weight of the inner wall 220 in addition to the other benefits they bring.

The inner wall 220 is made from two parts a first part 220*c* which extends from and is moulded integrally with the outer wall 360 of the body 30 and a second part 220*b* which is moulded separately. This enables easier assembly of the fan unit 70 within the handle 20 than a one piece inner wall.

Figure 12:
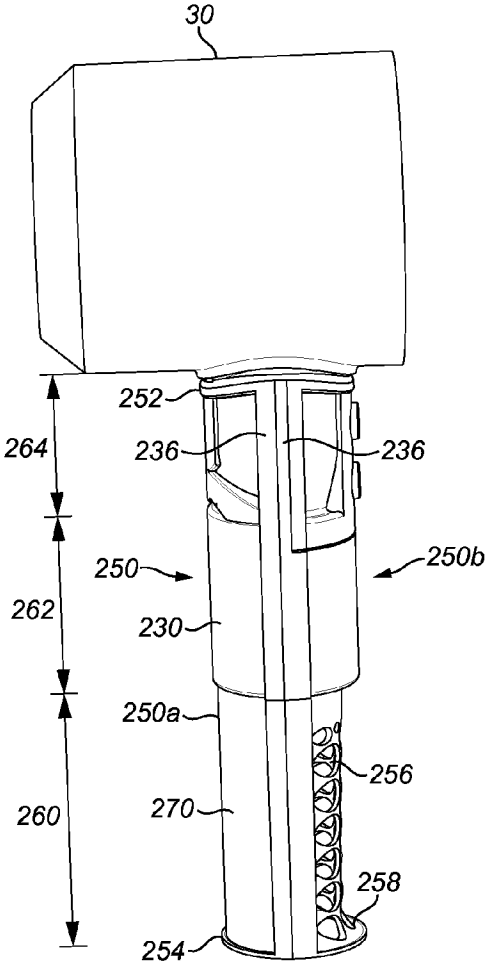
FIG. 12 shows the inner wall of FIG. 11 assembled.
Figure 11:
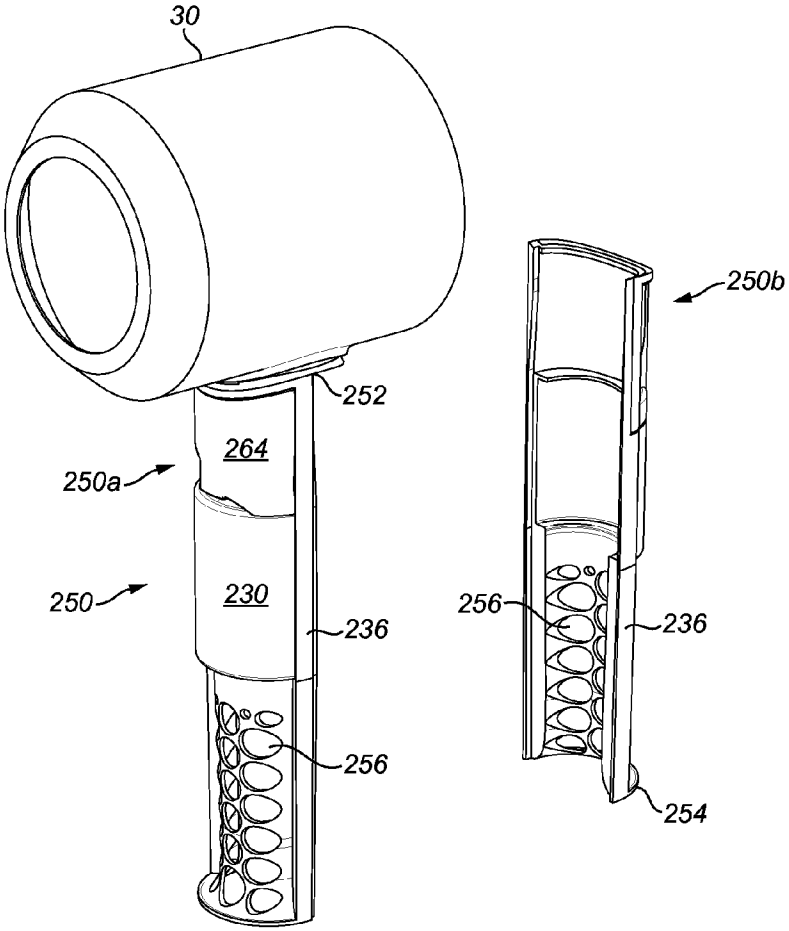
FIG. 11 shows an isometric view of an alternative inner wall.

An alternative arrangement of an inner wall 250 is shown in FIGS. 11 and 12. The inner wall 250 is formed from two parts, a first part 250*a* which is integrally moulded with the body 30 and a second part 250*b* which joins with the first part 250*a* to form a complete inner wall 250.

The inner wall 250 extends from a first end 252 which is connected to the body 30 to a second end 254 distal to the body 30. At the second end 254 and extending part of the way along to the fan unit housing 230 a plurality of perforations 256 are formed around the inner wall 250 this forms a first portion 260 of the inner wall. A second portion 262 of the inner wall comprises the housing 230 for the fan unit 70. The large aperture 258 is split into two by connecting struts 266. The connecting struts 266 have two main functions; a first function is to provide a point of connection between the first part 250*a* and the second part 250*b* of the inner wall 250. A third portion 264 of the inner wall extends from an upper end of the fan housing 230 to the first end 252 of the inner wall. This third portion 264 of the inner wall 250 has no apertures or perforations.

A lining material 270 is provided along the first portion 260 of the inner handle 250. For clarity, the lining material 270 has only been shown on the first part 250*a* of the inner wall, in use, the lining material 270 would extend all the way around the first section 260 of the inner wall 250. This lining material 270 is provided as two pieces one provided with respect to the first part 250*a* and one for the second part 250*b* of the inner wall.

The lining material 270 is provided to reduce noise produced when fluid is drawn into the primary fluid inlet 40 by the action of the fan unit 70. The lining material 270 is most effective when directly exposed to the fluid flowing in the primary fluid flow path 400. However, where the flow of fluid is being channeled into the inner wall 250 after being filtered by the foam block 48 it is beneficial to have the lining material 270 disposed behind a flow directing surface. The second end 254 of the inner wall 250 is shaped and curved 258 to provide a smooth flow path for fluid as it moves from the filter block 48 into the primary fluid flow path 400.

The perforations 256 of the inner wall 220 are of a diameter which is chosen to attenuate noise most effectively. Diameters of 1 mm to 10 mm are suitable; the smaller diameters being better for obtaining a good sound power (reducing sound over the main human sound range) and the larger diameters are good for high frequency attenuation. The perforations preferably form at least 40% of the surface area of the inner wall 220, 250.

By having the lining material 222 disposed behind the inner wall 220, 250 one is able to use a greater thickness of lining material than if the lining material 222 was directed exposed to the primary fluid flow path. This is because the diameter of the primary fluid flow path 400 is determined by the inner wall 220, 250 which squashes the lining material 220 in to the gap between the inner wall 220, 250 and the outer wall 200 of the handle 20.

FIGS. 13*a* to 16 show various views of an alternative detachable portion 244. This detachable portion 244 is made from a rigid plastic material which push fits onto the end 220*a* of the outer wall. The detachable portion 244 has an end face 246 which includes the second apertures 46 that form part of the primary fluid inlet 40 into the handle 20. The detachable portion 244 is generally 'U'-shaped having an outer rim 300 which includes a finger grip 302. The finger grip 302 is essentially a recess that extends part way into the rim 300 to provide purchase for a finger nail or coin, for example, which can be used to lever the detachable portion 244 off the end 200*a* of the handle 20.

Figure 14A:
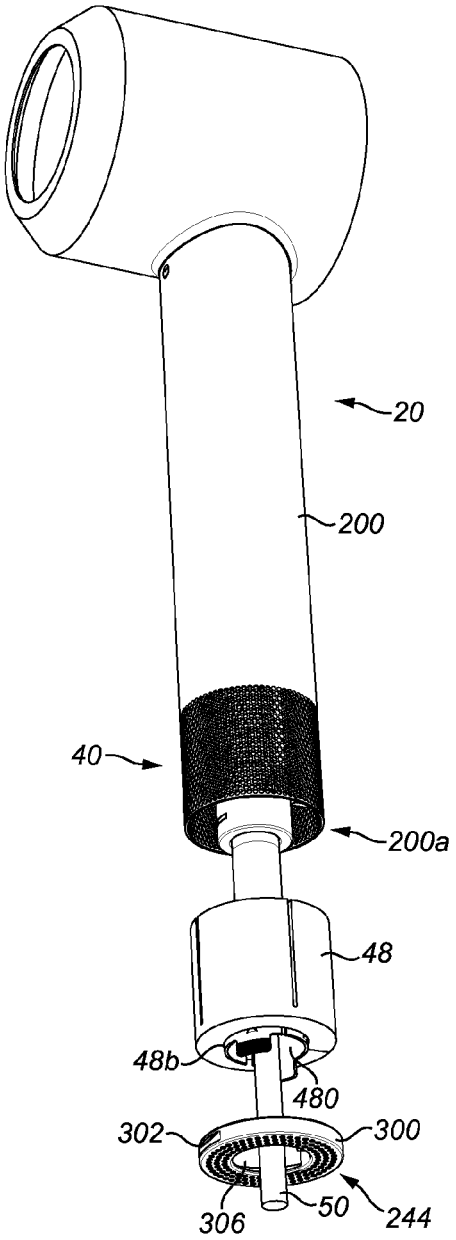
FIG. 14*a* shows the alternative appliance of FIG. 13*a* with an exploded inlet.
Figure 14B:
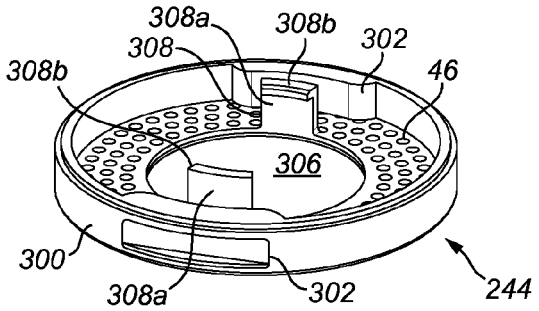
FIG. 14*b* shows the detachable portion of FIG. 14*a* in more detail.
Figure 16B:
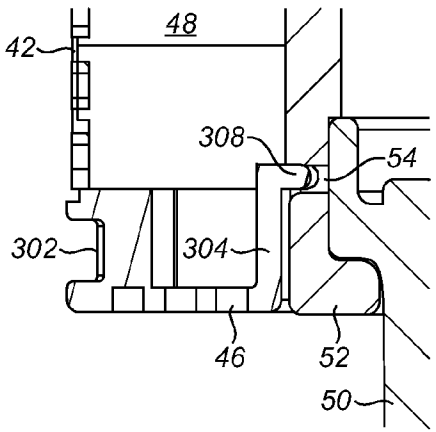
FIGS. 16*a* and 16*b* show the cross section of FIG. 15 is more detail.
Figure 16A:
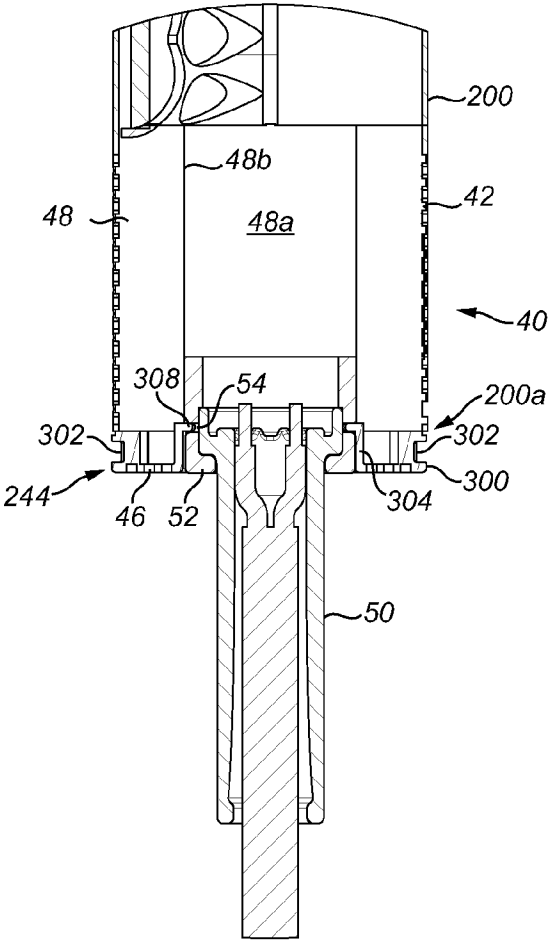
Figure 15:
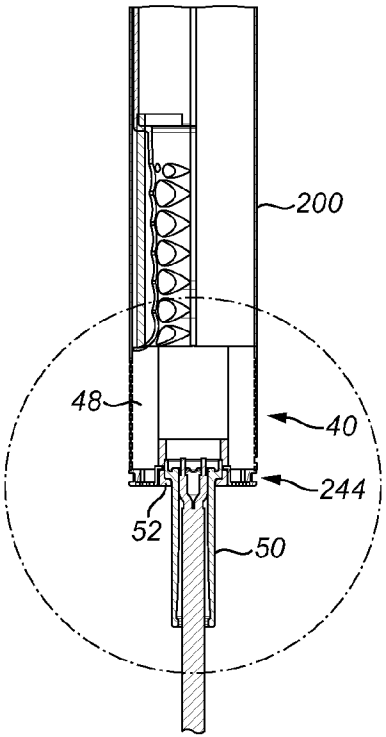
FIG. 15 shows a cross section through the inlet of the alternative appliance of FIG. 13*a*.

Two radially opposed finger grips 302 may be provided (FIGS. 14*b*, 16). This makes removal an easier task as the detachable portion 244 can be pulled along a longitudinal axis defined by the handle 20 and the power cable 50.

This detachable portion 244 abuts the end 200*a* of the handle 20 at the outer rim 300 and is secured into position at the end of the handle 20 via a pair of resilient clips 308. The resilient clips 308 are 'L'-shaped and include an extension up 208*a* from an inner rim 304 of the detachable portion 244. The inner rim 304 defines a central aperture 306 of the detachable portion through which the power cable 50 enters the handle 20. At the distal end of the extension up 208*a* from the inner rim 304, the resilient clips 308 have a lip 308*b* which extend radially inwardly of the rim 304 into the space defined by the central aperture 306 of the detachable portion 244.

The power cable 50 is housed within the handle 20 in a housing 52 which extends around the power cable 50. This housing includes a circular recess 54 adapted to retain the resilient clips 308. When the detachable portion 244 is inserted into the end 200*a* of the handle 20, the lip 308*b* of the resilient clip 308 is pushed radially outwards by the housing 52 until the detachable portion 244 is in its' attached position at which point the lips 308*b* move into the circular recess 54 holding the detachable portion 244 in place.

To remove the detachable portion 244 one simply pulls on the finger grip(s) 302 with sufficient force to flex the lips 308*b* of the resilient clips 308 far enough for it to pop out of the circular recess 54.

The recess within the housing 52 need not be circular; it could instead be a pair of recesses sized and spaced to receive the pair of lips 308*b*. This could be advantageous as it would provide control of the orientation of the detachable portion 244 with respect to the housing 54 and thus the handle 20.

It is preferred that a pair of finger grips 302 is used and that a finger grip 302 and a resilient clip 308 are paired so radially located at the same position around the detachable portion 244. This means that any force on a finger grip 308 is transferred directly across the detachable portion 244 to the relevant resilient clip 308.

Figure 13A:
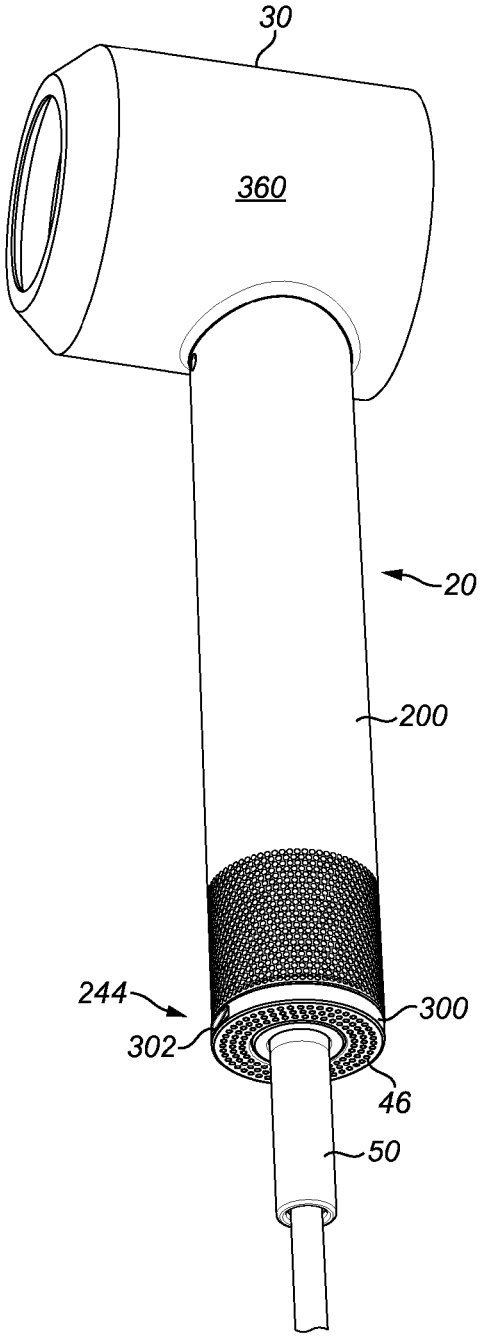
FIG. 13*a* shows an isometric view of an alternative appliance.
Figure 13B:
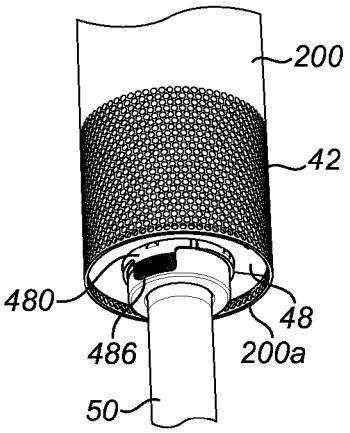
FIG. 13*b* shows the appliance of FIG. 13*a* without the detachable portion.
Figure 14C:
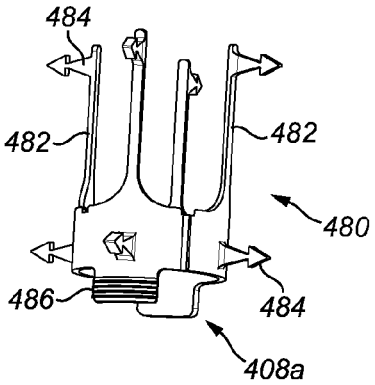
FIG. 14*c* shows the filter scaffold of FIG. 14*a* in more detail.

Referring now to FIGS. 13*b*, 14*a* and 14*c*, in order to facilitate the removal of the filter block 48 from within the handle 20, a filter scaffold 480 may be provided. The filter scaffold 480 has a number of ribs 482 which extend along the length of the filter block 48 at an inner surface 48*b* of the filter block 48 that is defined by the central aperture 48*a* of the filter block (FIGS. 3*b*, 10 and 14*b*). The ribs 482 include retaining features 484 which extend radially outwards of the ribs 482 into the material of the filter block 48. In this example, the retaining features 484 are arrow shaped, however other shapes could be used. At the downstream end 480*a* of the filter scaffold a pair of downwardly extending lugs 486 are provided. When the filter 48 and filter scaffold 480 are located within the handle 20 these downwardly extending lugs 486 are externally accessible (FIG. 13*b*) so can be gripped and pulled downwardly from the end 200*a* of the handle pulling the filter block 48 out of the handle 20.

Although the outer wall 200 of the handle 20 has been described as being made from a rolled sheet of metal, alternatives methods of manufacture and materials could be used; these include, but are not limited to, an extruded tube and a plastic extrusion/moulded tube or a composite tube such as carbon fibre reinforced plastic.

The invention has been described in detail with respect to a hairdryer however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hair care appliance comprising a handle having an inner wall and an outer wall extending along and around the inner wall, wherein the inner wall comprises a plurality of perforations extending at least partially along the inner wall, wherein the outer wall comprises a plurality of perforations, and wherein the plurality of perforations of the outer wall are upstream of the plurality of perforations of the inner wall such that the plurality of perforations of the outer wall are longitudinally spaced from the plurality of perforations of the inner wall.

2. The appliance of claim 1, wherein the inner wall comprises a plurality of perforations extending at least partially around the inner wall.

3. The appliance of claim 1, wherein the outer wall comprises a plurality of perforations extending at least partially around the outer wall.

4. The appliance of claim 1, wherein the outer wall comprises a plurality of perforations extending at least partially along the outer wall.

5. The appliance of claim 1, wherein the handle comprises a first end and a second end.

6. The appliance of claim 5, wherein the inner wall has a first end and a second end and the inner wall extends from the first end of the handle towards the second end of the handle.

7. The appliance of claim 5, wherein the outer wall of the handle extends from the first end towards the second end of the handle.

8. The appliance of claim 7, wherein the outer wall extends to the second end of the handle.

9. The appliance of claim 5, wherein the perforations in the outer wall are adjacent to the second end of the handle.

10. The appliance of claim 9, wherein the perforations in the outer wall extend along the handle towards the first end.

11. The appliance of claim 1, comprising a filter disposed within the outer wall extending across and around the perforations in the outer wall.

12. The appliance of claim 11, wherein the handle comprises a first end and a second end and the filter extends from the second end of the handle.

13. The appliance of claim 12, wherein the inner wall has a first end and a second end and the filter extends from the second end of the handle to abut the second end of the inner wall.

14. The appliance of claim 6, further comprising a filter disposed within the outer wall extending across and around the perforations in the outer wall wherein the filter extends from the second end of the handle to abut the second end of the inner wall.

15. The appliance of claim 14, wherein the second end of the inner wall is curved.

16. The appliance of claim 6, wherein the second end of the inner wall is curved.

17. The appliance of claim 1, wherein the inner wall comprises at least one supporting rib which projects between the inner wall and the outer wall.

18. The appliance of claim 17, wherein the at least one supporting rib extends longitudinally along the inner wall.

19. The appliance of claim 1, wherein a lining material is provided between the outer wall and inner wall of the handle.

20. The appliance of claim 1, wherein the handle comprises a fan unit wherein the inner wall comprises a housing for housing the fan unit in the handle.

21. The appliance of claim 20, wherein the housing is between a first end of the handle and a second end of the handle.

22. The appliance of claim 21, wherein the inner wall includes a plurality of perforations between the second end and the housing.

23. The appliance of claim 21, wherein the inner wall is unperforated between the housing for the fan unit and the first end of the handle.

24. The appliance of claim 1, wherein the inner wall is formed from a first part and a second part.

25. The appliance of claim 21, wherein the inner wall comprises a first portion adjacent the second end of the handle comprising a plurality of perforations, a second portion being unperforated and comprising the housing for the fan unit and a third portion extending from the second portion towards the first end of the inner wall which is unperforated.

26. A hand held appliance comprising a handle having an inner wall and an outer wall extending along and around the inner wall, wherein the inner wall comprises a plurality of perforations extending at least partially along the inner wall, wherein the outer wall comprises a plurality of perforations, and wherein the plurality of perforations of the outer wall are upstream of the plurality of perforations of the inner wall such that the plurality of perforations of the outer wall are longitudinally spaced from the plurality of perforations of the inner wall.

27. The appliance of claim 1, wherein the appliance is a hairdryer.

28. A hair care appliance comprising a handle having an inner wall and an outer wall extending along and around the inner wall, wherein the inner wall comprises a plurality of perforations extending at least partially along the inner wall, wherein the outer wall comprises a plurality of perforations, and wherein the outer wall extends longitudinally from an end of the inner wall such that the plurality of perforations of the outer wall are longitudinally spaced from the plurality of perforations of the inner wall.

* * * * *